United States Patent [19]

Price

[11] Patent Number: 4,522,586

[45] Date of Patent: Jun. 11, 1985

[54] THERMAL CONDITIONING OF MATERIAL IN CONTAINERS

[76] Inventor: Frank C. Price, 13812 Sandhurst Pl., Santa Ana, Calif. 92705

[21] Appl. No.: 556,141

[22] Filed: Nov. 29, 1983

[51] Int. Cl.[3] ..... F27B 9/28

[52] U.S. Cl. ..... 432/11; 432/145; 432/133; 432/59

[58] Field of Search ..... 432/9, 11, 13, 72, 121, 432/130, 133, 136, 137, 143, 144, 145, 146, 152, 153, 164, 171, 188, 201; 34/31

[56] References Cited

U.S. PATENT DOCUMENTS

| | | | |
|---|---|---|---|
| 1,416,595 | 5/1922 | Bailey | 432/11 |
| 1,658,333 | 2/1928 | Hanley | 432/171 |
| 2,119,346 | 5/1938 | Page | 126/272 |
| 2,298,149 | 10/1942 | Morton | 432/133 |
| 2,597,223 | 5/1952 | Burgess | 99/214 |
| 2,677,336 | 5/1954 | Spooner | 432/145 |
| 2,734,502 | 2/1956 | Bryant | 126/343.5 |
| 2,914,445 | 11/1959 | Clarke | 167/74 |
| 2,949,869 | 8/1960 | Leeuwrik | 432/152 |
| 3,154,663 | 10/1964 | Halvorsen | 219/10.49 |
| 3,290,030 | 12/1966 | Goehring | 432/133 |
| 3,947,235 | 3/1976 | Bornert | 432/72 |
| 4,165,964 | 8/1979 | Yonezawa et al. | 432/59 |

FOREIGN PATENT DOCUMENTS

| | | | |
|---|---|---|---|
| 390168 | 11/1973 | U.S.S.R. | 432/144 |

OTHER PUBLICATIONS

Vermeer, et al., "Vox Sang.", 30:1-22 (1976).

*Primary Examiner*—Henry C. Yuen
*Assistant Examiner*—John Kwon

[57] ABSTRACT

The process treats a continuous stream of containers of solid material effecting melting or heating of the material within the package. The dwell time within the process is minimized while at the same time the maximum temperature achieved by any of the material is held within an allowable maximum.

1 Claim, 2 Drawing Figures

THERMAL CONDITIONING OF MATERIAL IN CONTAINERS

BACKGROUND

1. Field of the Invention

The present invention relates to the continuous thermal conditioning of material in a container. This may involve melting of the material or simply warming it up. More specifically, the process is applied to the thawing of blood plasma in plastic bottles.

SUMMARY OF THE INVENTION

Melting Packaged Materials

The heating of any packaged material in a commercial process will always be more efficient if it is done as fast as possible, thus with a maximum allowable temperature in the heat-supplying medium. For materials which are sensitive, because of thermal degradation or boiling, to a given maximum temperature, the heating process must be controlled to preclude the reaching of that temperature. Thus, the subject invention is the heating of the material as fast as possible within the allowable limit of temperature in the material at any time during the process for all the contents of the package.

When the temperature-limited process is applied to fast melting the process is complicated by the fact that the heat of fusion being introduced is moderated in its temperature by the cooling effect of the melting remainder solid on the liquid phase which has been created and which transfers the heat of fusion from the container wall to the remaining, diminishing solid piece.

The materials which might be involved in such a process could be frozen foods, food materials which are solid at room temperature, and raw materials such as plastics or chemicals. For the purpose of demonstration this invention is discussed as it is applied to the thawing of frozen blood plasma.

The thawing of blood plasma into a liquid at temperatures near the melting point will result in a precipitate which is rich in the antihemofilic factor (AHF), Factor VIII. It has been found that more AHF is recovered in the precipitate if the thawing is fast. In addition to being fast, since there are frequently thousands of containers of frozen plasma to be thawed within one eight hour shift, it could be very advantageous to thaw in a continuous manner which is largely mechanized and automatic. Thus, machinery with a large volume output which is easily managed by a few people could be economically attractive. To do this best, the process should be continuous. The process could then feed a continuous AHF purification process would be conducive to higher yields of the purified AHF compared to a batch process. This can occur because of faster processing and because in a continuous stream the amount of admixing among donations in part of the process can be reduced.

If the plasma is first thawed inside its container, then the plasma and container are readily separated. Also, there is some indication that large numbers of donations mixed together during processing tend to lead to overall poorer AHF recovery. If the plasma is thawed inside the container, using the container as the barrier between the heating medium and the plasma, then a much greater surface-to-volume ratio for heating is more easily achieved than it would be if the frozen plasma were first removed from the container in large numbers and then thawed in a large pool.

Heat Transfer.

Fast thawing implies high heat transfer rates and high temperatures of heating medium. During the fast thawing the temperature of the plasma at the container wall should not rise above a certain maximum temperature between 6° and 10° C. Above the maximum the precipitate in the thawed portion of plasma in the bottle tends to dissolve with a loss of recoverable AHF. The outer wall surface of the bottle can only be heated to a temperature which, combined with bottle wall thermal conductivity, the inner surface boundary layer conductivity, and the temperature of the melt in the bottle, does not define too high a temperature at the inner surface of the wall. The temperature elevation of the heating medium above the plasma temperature serves to drive the heat of fusion into the bottle. The temperature elevation must be arranged to be less and less as the plasma thawing progresses because the lessening ice mass in the container continuiously loses its ability to cool the inner wall of the bottle. Implicit to any rapid thawing process is the need for motion of the bottle contents inside the bottle to enhance the transfer of heat from the bottle wall to the remaining ice piece.

The Invention

The subject invention is a process which allows fast thawing of plasma without excessive container wall temperatures. The plasma containers and the heating medium, normally warm water, flow in a concurrent stream. The flow rate and temperatures of the inlet water are set in proportion to the flow rate of plasma such that both streams arrive at nearly the same temperature upon completion of the thaw, the temperature being in the range of 0° to 8° centigrade. Also, during the thawing the inner bottle wall does not exceed a given maximum allowable temperature such as a temperature between 6° and 10°.

The transient conditions of this thawing action within the container vary widely as the piece of remelting frozen plasma diminishes in size. In order for this reduction in cooling propensity by the ice to take place without the inner wall ever achieving an excessive temperature, a certain minimum agitation within the bottle must be created. The bottle can be agitated in any rotational or gyratory manner.

The heating medium can be any liquid such as water which surrounds or is sprayed onto the agitated container or it can be air passing over the container. Steam or moist air can be used whereby part of the heat of fusion is furnished from the heat of condensation of the gaseous water content of the flowing air stream.

The fundamental engineering parameters of the process can be described as follows:

Heating Medium
- Density, viscosity, heat capacity, thermal conductivity, heat of condensation
- Mass flow rate, velocity, inlet temperature, outlet temperature Container
- Wall thermal conductivity
- Surface-to-volume ratio Agitation
- revolutions per minute
- shakes per minute
- amplitude of shake residence time in heating medium Solid Material mass flow rate through the process melting point, heat of fusion Molten Material Density, viscosity, heat capacity, thermal conductivity Most of these parameters can be handled by one knowledgeable in the art to arrange the process for overall heat balance. The most important goal to achieve is the use of conditions which produce the shortest residence time/warmest possible medium conditions without exceeding the allowable maximum container inner wall temperature. This can be done by setting process conditions on the basis of measurements made of the container inner wall temperature throughout the residence time of a sample container used in the process and containing the material to be thawed. This can be done within the motions of the process developed on the container by means of thermocouples, wires and commutators or by radio transmitted signals of temperature from the moving container. A more crude optimization of the process can be obtained by studying after the fact, the indication of what maximum temperature was achieved by using suitable indicators attached to the surface before the bottle is thawed or by examination of the quality of the melted material for indication of thermal damage.

This method of melting can also be seen in terms of heating only without change of phase. The contents of the package could be heated to increase its temperature to a desired level without reaching the melting point or this could be done to material which is liquid to begin with and which is only heated to a prescribed level without exceeding a given temperature limit.

DESCRIPTION OF THE PREFERRED EMBODIMENTS

Figure 1:
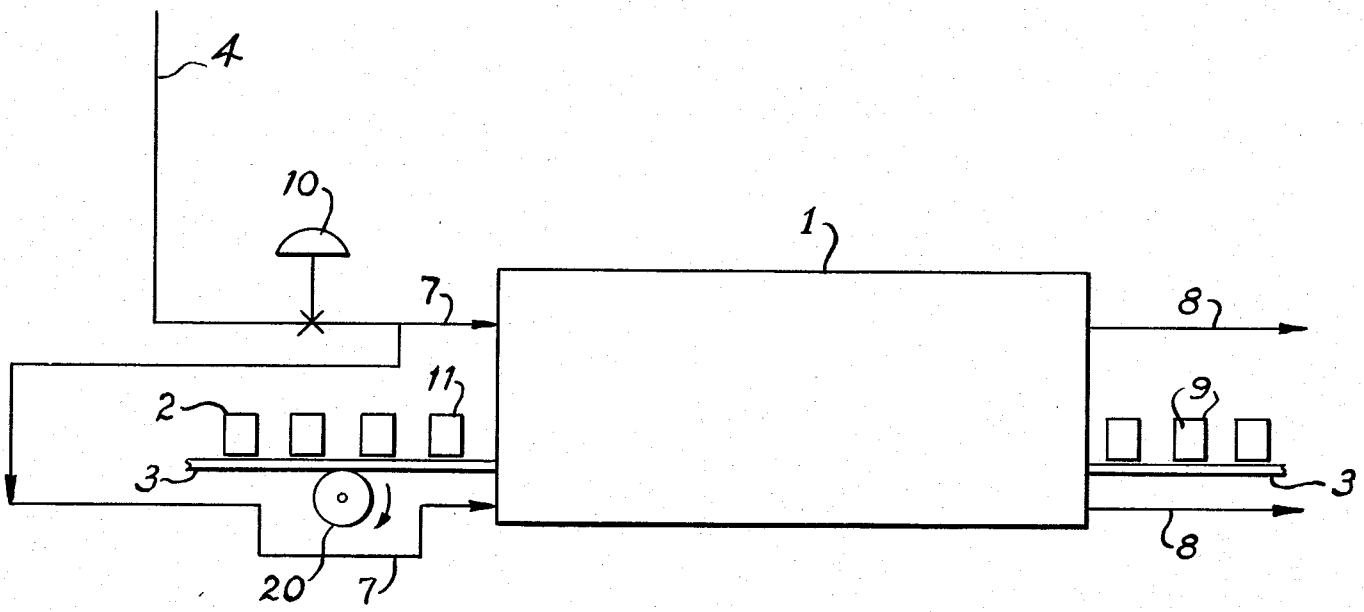
FIG. 1 is a flowsheet showing the invention diagrammatically, in its broadest aspect.

Referring to the drawings, there is illustrated in FIG. 1 a chamber 1 for the entering stream of containers 2 of material before thermal conditioning, carried through or to the chamber 1 continuously on transport device 3 and the stream of concurrently flowing heating medium 4 which is (controlled) produced at a given temperature (by the exchanger 5 and a heat source 6), the flow rate of medium 4 being regulated by controller 10 such that (the source of) heating medium 4 becomes entering a properly conditioned flow 7 ready to interact concurrently with stream 2 within the chamber 1 interract concurrently with stream 2 within the chamber 1.

The transport device 3 is moved by impeller 20 which operates at regulated speed to determine the desired residence time of the container 2 within the chamber 1. In the case where the container 2 would move through the chamber 1 by gravity then an appropriate metering device would be needed at the bottom end to control the residence time. The material in containers 2 exits the chamber 1 at the desired thermal condition 9, the heating medium now at 8 having lost energy in the amount that was picked up as the container 2 were warmed to the desired energy level shown as container 9. Thus, is described a seemingly simple process of concurrent heat exchange. However, in this case the process operates to a singular important effect; the containers 2 are warmed continuously through the chamber 1 by medium 7 which is set at a flow rate and a temperature such that even though at the initial and throughout a portion of the chamber 1 the temperature of flow 7 is excessive for the material 11 in containers 2, the excessive temperature is never reached as the temperature of the heating medium 7 is moderated by the heat transfer resistances of the boundary layer at the wall of container 2 and the container wall itself. In order to condition the material 11 as fast as possible, which means a greater process capacity for a given chamber 1, the flow and temperature at 7 is set to just reach the maximum allowable temperature in the material 11 at the inner wall of containers 2 during their transport through the chamber 1.

Figure 2:
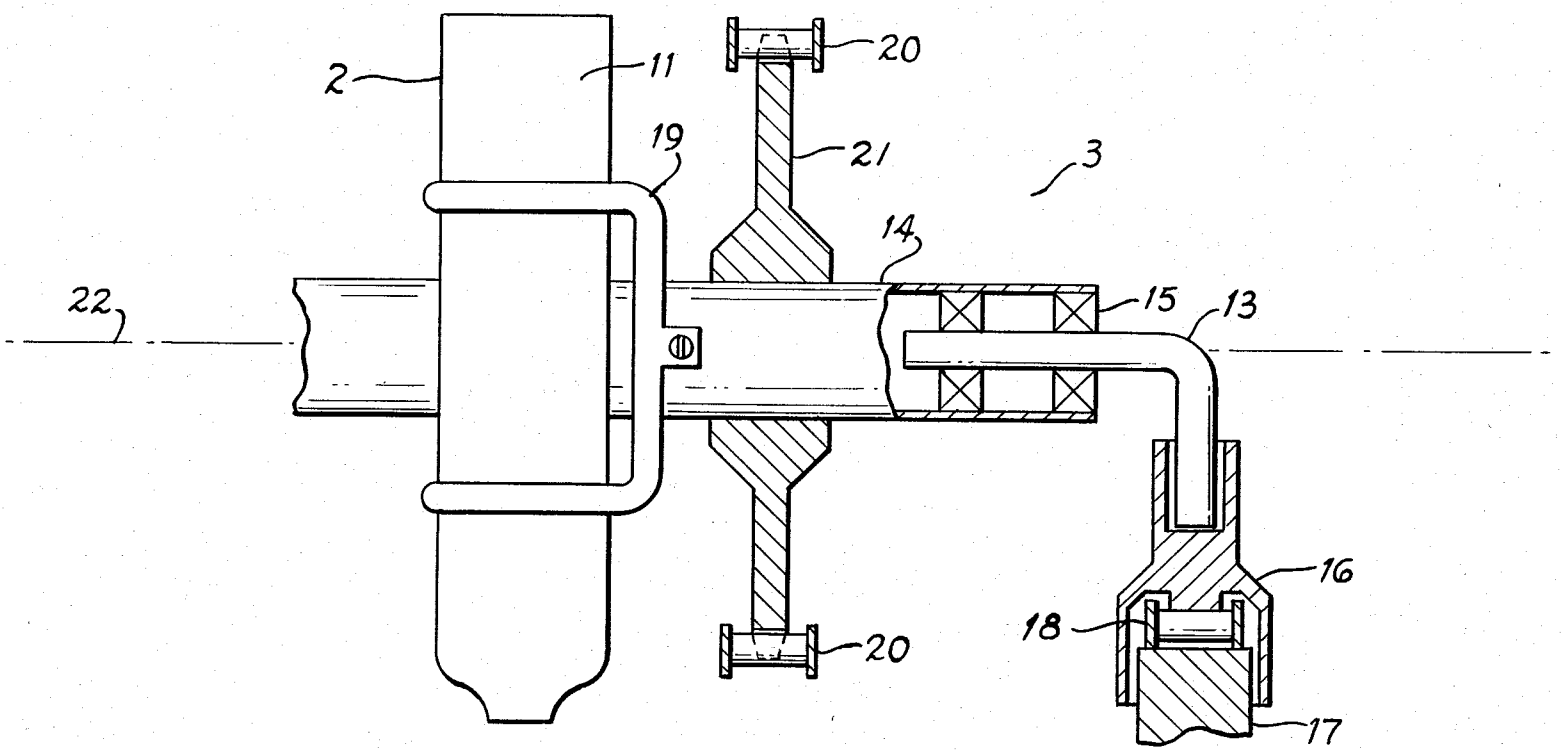
FIG. 2 illustrates an example of the agitation of containers as they move through a thermal conditioning chamber. It is an end view of a continuous belt of moving, rotating container holders.

There is illustrated in FIG. 2 an end view of a portion of a bottle transport device 3 which imparts a motion to the containers 2 to impart a relative motion between the container and the contents 11 within the container in the case where all or part of the contents 11 is fluid. This motion allows higher heat transmission to the contents 11 without excessive temperatures being developed on the inside of the wall of container 2. As an example of how movement of the container 2 can be effected for transport through a chamber while at the same time motion of the containers 2 can be developed in order to input relative between the container 2 and the contents 11, there is shown an axel 13 holding a shaft 14 riding on bearings 15, the axel 13 being supported by base 16 which is moved along a support 17 by endless chain 18. As the base 16 is moved along the support 17 the shaft 14 also moves carrying with it the container 2. The container 2 is held to the shaft 14 by the clamps 19. An endless container-motion chain 20 moves at a faster rate than chain 18 and thus imparts a rotational motion to the gear wheel 21 which causes shaft 14 and container 2 to rotate about axis 22.

It can readily be understood that shaft 14 could hold many containers 2 and be suported at its other end with devices similar to axel 13 and base 16. It also can readily be understood that multiple shafts 14 could be arranged to fllow one another along support 17. The support can extend through a chamber which has thermal conditioning medium flowing concurrently with the containers.

FIG. 2 is not intended to define completely a machine for container motion and container delivery through a chamber. Rather, it illustrates the process step of moving and agitating a container 2 of material 11 as it could be moved through the chamber 1 shown in FIG. 1. FIGS. 1 and 2 are presented as an example of only one of many ways to conduct a concurrent process of containers and thermal conditioning medium which facilitates the basic concept of thermal conditioning with the controlling of peak temperature in the material contents of the stream of containers.

A typical example of the heat and material balances for thawing a bottle of blood plasma is described approximately as follows:

| | |
|---|---|
| Bottle Contents, grams | 650 |
| Contents heat of fusion, cal/gm | 80 |
| Contents inlet temperature, °C. | (−)25 |
| Contents heat need to liquid at 4° C., kcal | 61 |
| Total heat demand of process for rate of | 1220 |

-continued

| | |
|---|---|
| 20 bottles per minute, 15 min residence time in chamber, 300 bottles in chamber kcal/minute | |
| Heater water flow rate 30° in, 6° out, lites/min. | 51 |
| Water temperature in chamber where thaw is 50% complete, °C. | 18 |
| Assume container inner wall temp. °C. | 6 |
| Container surface area, $m^2$ | 0.08 |
| Assume liquid contents temperature °C. | 4 |
| Container wall is plastic with thermal conductivity kg cal/(hr) ($m^2$) (°C.) | 150 |
| Water heat transfer rate on bottle kg cal/(hr) ($m^2$) (°C.) | 730 |
| Required internal wall surface heat transfer rate by agitation to hold 6° wall kg/cal/(hr) ($m^2$) (°C.) | 730 |
| Overall heat transfer rate kg cal/(hr) ($m^2$) (°C.) | 100 |

Thus, a process which uses the above conditions must have adequate agitation to produce the above-indicated internal heat transfer coefficient of 730.

Later in the thaw period for a bottle, after 85% of the solid has become liquid, the following tabulated conditions apply:

| | |
|---|---|
| Water temperature in chamber, °C. | 9.6 |
| Assume ice chunk L/D | 3/1 |
| Area of ice chunk, $m^2$ | 0.015 |
| Assumed container surface area, $m^2$ | 0.08 |
| Heating rate, water-to-plasma, kg cal/min | 0.7 |
| Melting point of plasma, °C. | (−)0.5 |
| Required ice surface heat transfer coef. to hold 4° C. liquid, kg cal/(hr) ($m^2$) (°C.) | 1100 |

Thus, it is demonstrated how a process which has all of the above conditions must also have adequate agitation to produce the above-indicated heat transfer coefficient at the ice surface.

These calculations illustrate that, for thawing processes, there must be a certain minimum amount of agitation to meet the needs of rapid heat transfer for a fast, complete, thaw. Other points throughout the thaw period can be analyzed and measured as part of optimizing the process for fastest effect without overheat of the material.

While the above descriptions contain many specifications, these should not be construed as limitations on the scope of the invention, but rather as an exemplification of the concept of achieving the most rapid thermal conditioning without exceeding a given maximum material temperature. The indicated method of container agitation is only one of many possible rotational, vibrational or reciprocating actions hich might be imparted to the container.

In the case of a packaged solid, which is heated only and not melted, without exceeding a given maximum temperature, the process is adjusted in its temperature and mass flow of heating medium in order to not exceed the heat input beyond the thermal diffusivity capacity of the solid which reaches a minimum at the end of the process. Compared to the solid metaling case, a greater mass flow of heating medium at a lower temperature would be required.

I claim:

1. A method of thawing frozen blood plasma within the plasma containers, the object being to thaw the plasma rapidly without a given maximum temperature in any portion of the thawed plasma during the process being exceeded, the containers of plasma being given cyclic motion rotated or shaken while in contact with a heat delivering medium comprising:

continuously flowing of containers through a contacting chamber, continuously flowing concurrently with the containers the heating medium, contacting within the chamber the medium with the outer surfaces of the containers, setting the inlet temperature of the medium, setting the rate of flow of containers, setting the mass flow rate of medium, gradually dropping the heat exchange along the length of the chamber between the material and the medium gradually thawing the plasma and gradually reducing the temperature level of the medium along the chamber length, maintaining throughout the chamber the container innerwall temperatures below ten degrees centigrade.

* * * * *